US007221105B2

(12) United States Patent
Chliwnyj et al.

(10) Patent No.: US 7,221,105 B2
(45) Date of Patent: May 22, 2007

(54) ELECTROMAGNETIC RADIATION EMITTING BULB AND METHOD USING SAME IN A PORTABLE DEVICE

(76) Inventors: Katarina M. Chliwnyj, 6830 N. Yuma Mine Rd., Tucson, AZ (US) 85743; Alex Chliwnyj, N. Yuma Mine Rd., Tucson, AZ (US) 85743

( * ) Notice: Subject to any disclaimer, the term of this patent is extended or adjusted under 35 U.S.C. 154(b) by 95 days.

(21) Appl. No.: 10/492,516

(22) PCT Filed: Oct. 15, 2002

(86) PCT No.: PCT/US02/33234

§ 371 (c)(1),
(2), (4) Date: Apr. 14, 2004

(87) PCT Pub. No.: WO03/034458

PCT Pub. Date: Apr. 24, 2003

(65) Prior Publication Data

US 2004/0190291 A1 Sep. 30, 2004

Related U.S. Application Data

(60) Provisional application No. 60/329,480, filed on Oct. 15, 2001, now abandoned.

(51) Int. Cl.
*H05B 37/02* (2006.01)

(52) U.S. Cl. ..... 315/291; 315/312

(58) Field of Classification Search ..... 315/291, 315/312; 363/15; 362/227; 320/114
See application file for complete search history.

(56) References Cited

U.S. PATENT DOCUMENTS

| | | | | |
|---|---|---|---|---|
| 3,953,768 | A | 4/1976 | Meredith et al. | 361/92 |
| 5,646,484 | A * | 7/1997 | Sharma et al. | 315/74 |
| 6,147,457 | A | 11/2000 | Lohn et al. | 324/142 |
| 6,296,367 | B1 * | 10/2001 | Parsons et al. | 362/183 |
| 6,791,283 | B2 * | 9/2004 | Bowman et al. | 315/291 |
| 2002/0047645 | A1 * | 4/2002 | Miyagawa | 315/307 |

* cited by examiner

*Primary Examiner*—Thuy Vinh Tran
(74) *Attorney, Agent, or Firm*—Chandler & Udall LLP; Dale F. Regelman

(57) ABSTRACT

An electromagnetic radiation emitting bulb, comprising a housing; one or more power input terminals disposed on that housing; a voltage converter disposed within the housing, where the voltage converter is electrically connected to the one or more power input terminals; and one or more electromagnetic radiation emitting devices disposed within the housing, where those one or more electromagnetic radiation emitting devices are electrically connected to the voltage converter. A method to emit electromagnetic radiation from a hand-carried device comprising an electromagnetic radiation emitting bulb and one or more battery cells. The method supplies first DC power having a first voltage from the one or more battery cells to the bulb, converts within the bulb the first DC power to second DC power having a second voltage, supplies within the bulb the second DC power to one or more electromagnetic radiation emitting /devices, and emits electromagnetic radiation.

6 Claims, 14 Drawing Sheets

ELECTROMAGNETIC RADIATION EMITTING BULB AND METHOD USING SAME IN A PORTABLE DEVICE

CROSS-REFERENCE TO RELATED APPLICATIONS

This Application claims priority from a U.S. Provisional Application having Ser. No. 60/329,480 filed on Oct. 15, 2001, now abandoned and an International Application having Application No. PCT/US02/33234 filed on Oct. 15, 2002.

FIELD OF THE INVENTION

The present invention relates generally to a single bulb unit which emits electromagnetic energy. In certain embodiments, Applicant's bulb produces visible light. In other embodiments, Applicant's bulb emits electromagnetic radiation in one or more non-visible portions of the spectrum, such as infrared radiation and/or ultraviolet radiation.

BACKGROUND OF THE INVENTION

Low voltage light bulbs typically comprise one or more incandescent elements in a glass envelope. At best, such incandescent bulbs have short lifetimes. In addition, such incandescent light bulbs are fragile, and if dropped have even shorter lifetimes. In addition, these incandescent light bulbs are inefficient at converting electric energy into visible light, i.e. photons. The brightness of an incandescent light bulb is generally ay function of the voltage applied. In flashlight applications, to get a brighter light one needs to use more batteries. However, a different low voltage incandescent light bulb is required for each discrete number of battery cells.

Alkaline batteries typically provide a voltage of about 1.5 volts per cell. An incandescent bulb that is designed to be powered by one cell will burn out if powered by two or more cells in series. On the other hand, a bulb designed to operate using 4.5 volts, provided for example from three alkaline cells in series, will not produce much light if powered by a single cell. When powered by two cells such a device will produce a light having a yellowish cast due to the lower temperature filament. When powered by a single cell the light emitted from such a device will be very dim. Therefore, in order to provide sufficient light output, a different light bulb is needed for each combination of battery cells.

The required multiplicity of light bulbs is further compounded with use of rechargeable batteries. Nickel Cadmium cells (NICAD, for example, typically have a voltage of about 1.2 volts per cell. A bulb designed for use with three alkaline cells, however, will not provide sufficient light if powered by three NICAD cells. Thus, a different light bulb is required for each combination of NICAD cells. Needless to say, a single bulb using incandescent technology that can be usefully operated over a large input voltage range would be highly desirable. Applicant's invention comprises such a light bulb.

It is known in the art that light emitting diodes, i.e. LEDs, can overcome some of the limitations inherent with incandescent light bulbs. However, the applied voltage must be high enough to overcome the characteristic voltage drop of the LED. Typically, a preferred method to operate an LED is to use a voltage higher than the turn on voltage of the LED, and to limit the current through the LED with a current limiting resistor. This requires using a voltage higher than that actually required by the LED. Such a method, however, prevents LEDs from being used as lighting elements with very low voltage systems. In addition to voltage-related problems, light emitting diodes can be destroyed by driving too much current through the device. Thus, use of an LED requires adjustment of both the voltage and current supplied to that LED.

Prior art LED light bulbs are designed for use with only one specific voltage. This specified voltage must necessarily exceed the voltage drop of the LED. In addition, these prior art devices include one or more LEDs in combination with one or more dropping resistor(s) to limit the current to the LED(s). Typically such prior art LED light bulbs require three battery cells in series to provide more than four volts to light a white LED.

The difficulties inherent with use of such prior art LED light bulbs are also compounded if rechargeable batteries are used. As noted above; Nickel Cadmium cells (NICAD) typically have a voltage of about 1.2 volts per cell. Using three such NICAD cells only provides about 3.6 volts, which is marginal for some white LEDs. Use of four cells, however, can result in premature LED device failure. Therefore, use of NICAD cells to power an LED light bulb requires four NICAD cells in combination with one or more current limiting resistors. Such a combination is necessarily designed for a specific voltage based upon the voltage drop of the LED and the current limiting resistor(s).

Thus, use of such prior art LED light bulbs is subject to constraints almost identical to use of incandescent bulbs. What is needed is an LED light bulb that can be used over a wide range of input voltages. Such a device can be used interchangeably with, for example, a flashlight using one, two, or three, batteries, where those batteries may be of the non-rechargeable or rechargeable type. Applicant's invention comprises such an LED light bulb.

SUMMARY OF THE INVENTION

Applicant's invention includes a bulb, comprising a housing; one or more power input terminals disposed on that housing; a voltage converter disposed within the housing, where the voltage converter is electrically connected to the one or more power input terminals; and one or more electromagnetic radiation emitting elements/devices disposed within the housing, where the one or more electromagnetic radiation emitting elements/devices are electrically connected to the voltage converter.

Applicants' invention further includes a method to emit electromagnetic radiation from a hand-carried device composing Applicant's bulb and one or more battery cells. Applicant's method supplies first DC power having a first voltage from the one or more battery cells to the bulb, converts within the bulb the first DC power to second DC power having a second voltage, supplies within the bulb the second DC power to one or more electromagnetic radiation emitting elements/devices, and emits electromagnetic radiation.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

This invention is described in preferred embodiments in the following description with reference to the Figures, in which like numbers represent the same or similar elements. The invention will be described as embodied in an apparatus and method to provide a portable light-emitting assembly, i.e. a flash light. The following description of Applicant's apparatus and method is not meant, however, to limit Applicant's invention to portable devices or to devices emitting visible light, as the invention herein can be applied generally to electromagnetic radiation emitting devices.

Figure 1:
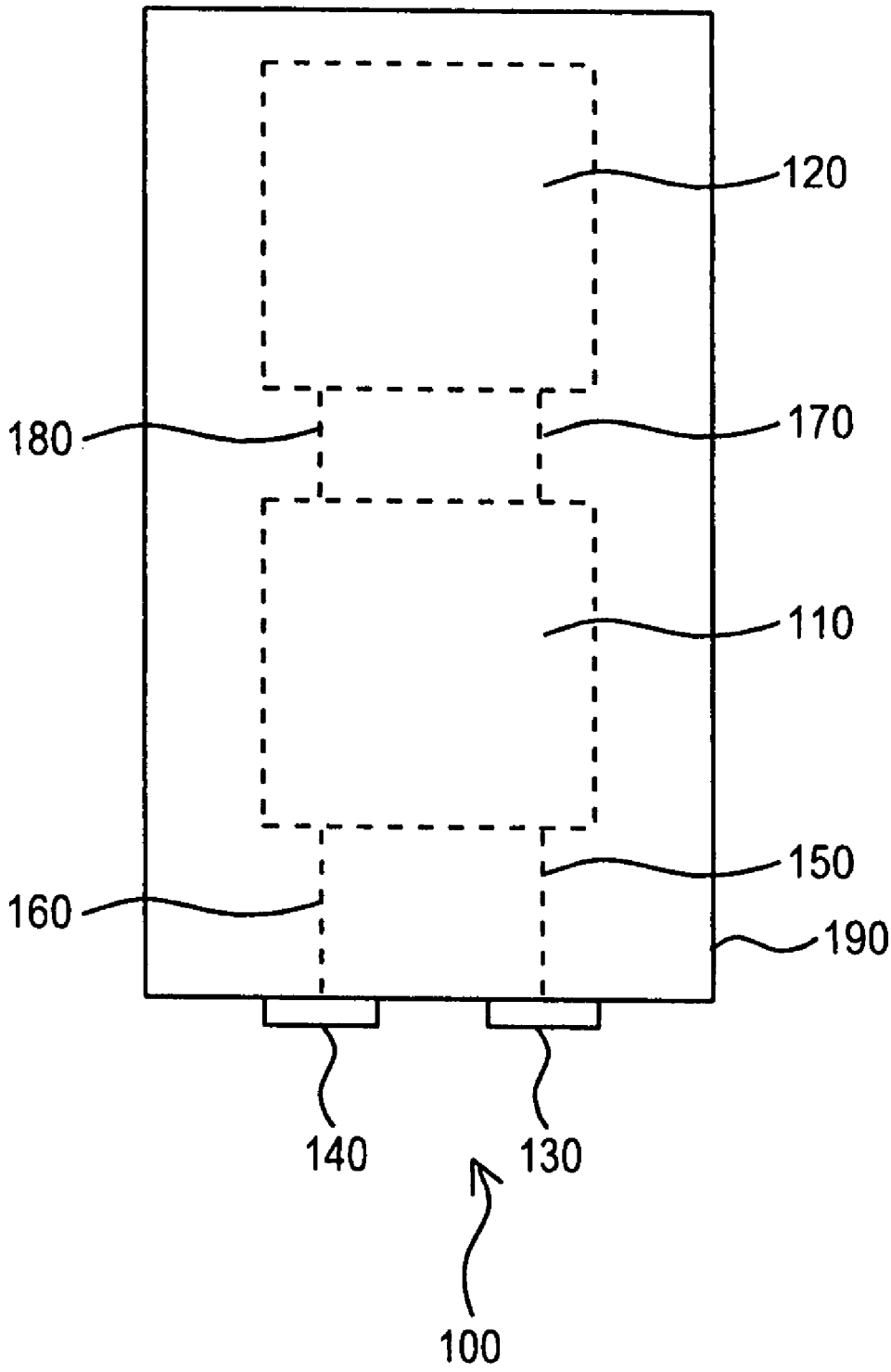
FIG. 1 is a block diagram of a first embodiment Applicant's bulb.

Referring now to FIG. 1, apparatus 100 includes housing 190, voltage converter assembly 110, and one or more electromagnetic radiation emitting devices 120. In certain embodiments, electromagnetic radiation emitting devices 120 are capable of emitting visible light. By "visible-light," Applicant means radiation having a frequency of about $10^{14}$ hertz to about $10^{15}$ hertz. In certain embodiments, one or more electromagnetic radiation emitting devices 120 comprise one or more incandescent elements. In certain embodiments, one or more electromagnetic radiation emitting devices 120 comprise one or more light emitting diodes ("LED"). In certain embodiments, one or more electromagnetic energy emitting devices 120 comprise a combination of one or more incandescent elements and one or more LEDs.

In certain embodiments, electromagnetic energy emitting devices 120 comprise one or more pulsed laser diodes. Available peak output power ranges from 5 W to 175 W when operated a 160 ns pulse width. Significant increases in peak power are attainable at shorter pulse widths. Applicant's laser diode bulb is useful for use in, without limitation, laser range finding, speed determination, light detection and ranging ("LIDAR"), optical fusing, collision avoidance, high speed switching, and weapons simulation. In certain of these laser diode embodiments, electromagnetic energy emitting devices 120 emit radiation having wavelengths of about 805, 870, 905, 1550 nanometers, and combinations thereof.

In certain embodiments, Applicant's bulb includes one or more electromagnetic energy emitting devices 120 which emit radiation in the microwave frequency spectrum, i.e. frequencies from about $10^8$ hertz to about $10^{11}$ hertz. In certain embodiments, Applicant's bulb includes one or more electromagnetic energy emitting devices 120 which emit radiation in the infrared frequency spectrum, i.e. frequencies from about $10^{11}$ hertz to about $10^{14}$ hertz. In certain embodiments, Applicant's bulb includes one or more electromagnetic energy emitting devices 120 which emit radiation in the ultraviolet frequency spectrum, i.e. frequencies from about $10_{15}$ to about $10^{16}$ hertz, and combinations thereof.

In certain embodiments, voltage converter assembly 110 converts DC power having a first voltage to DC power having a second voltage. In other embodiments, voltage converter assembly 110 converts AC power having a first voltage to DC power having a second voltage. In certain embodiments, the first voltage is greater than the second voltage. In certain embodiments, the AC input power has a voltage between about 12 volts and about 250 volts. In certain embodiments, the second voltage is greater than the first voltage, i.e. voltage converter assembly 110 comprises what is sometimes called a "boost" converter.

In certain embodiments, voltage converter assembly provides a regulated output. By "regulated output," Applicant means the nominal output voltage changes less than about plus or minus 10 percent during operation as long as the input voltage is within a specified range. In certain embodiments, assembly 10 comprises a step-up/step-down converter which provides a regulated output of about 5V where the specified input voltage range is between about 0.8V and about 6V.

Figure 11:
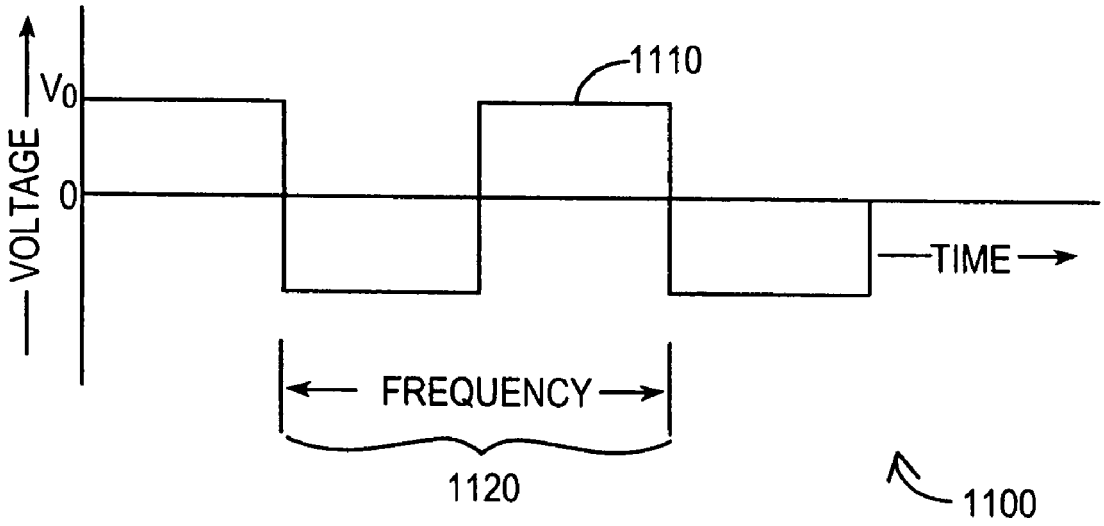
FIG. 11 is a graph showing the frequency of a first and second AC power produced by Applicant's bulb.
Figure 12:
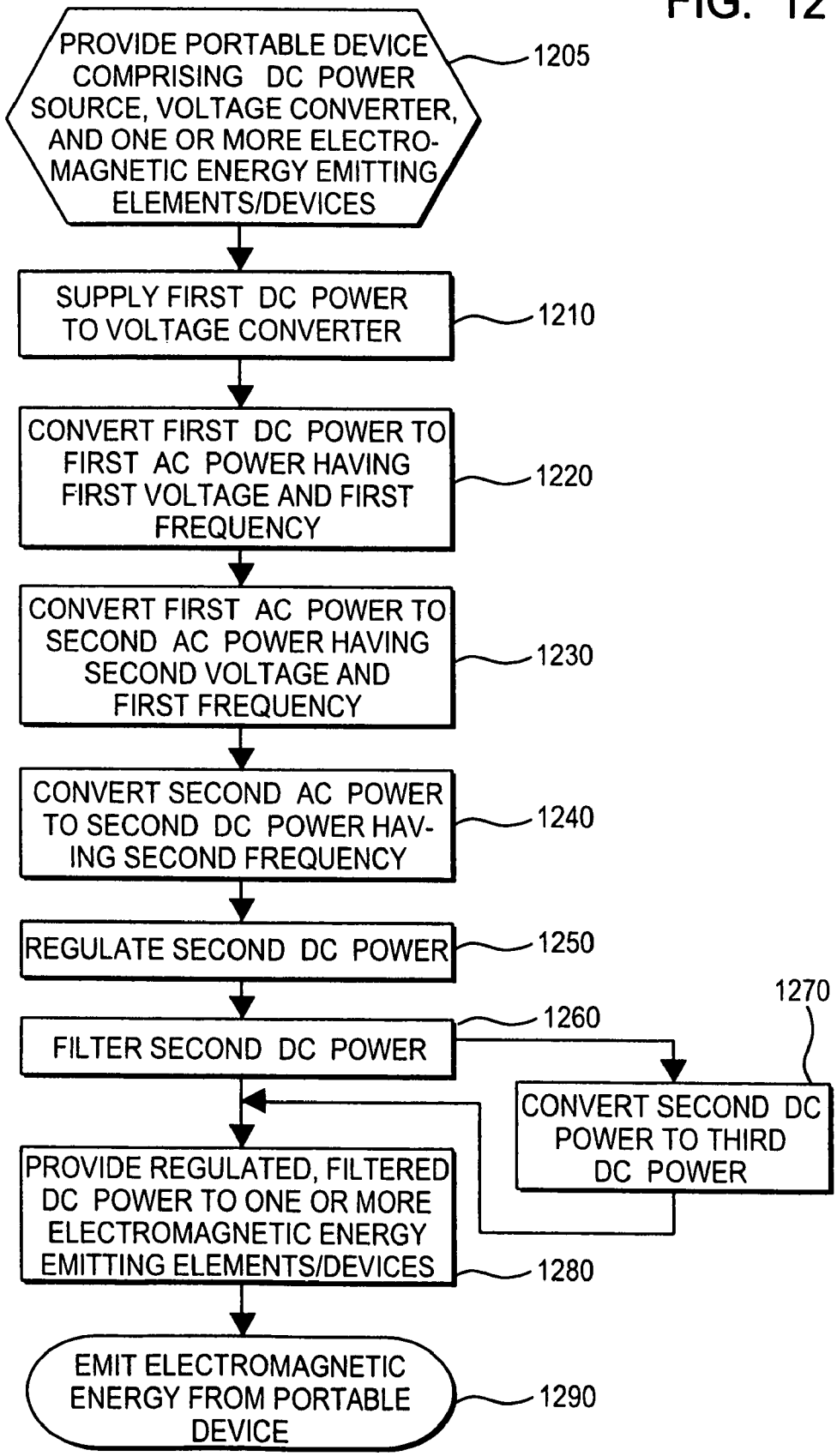
FIG. 12 is a flow chart summarizing the steps of Applicant's method to emit electromagnetic radiation from a portable device using Applicant's bulb.

Referring now to FIG. 12, in step 1210 Applicant's light bulb provides DC power having a first voltage to converter 110. In step 1220, Applicant's light bulb converts that input DC power into AC power having the first voltage and a first frequency. Referring to FIG. 11, curve 1110 shows that first AC power having voltage $V_0$ and frequency 1120. In certain embodiments, frequency 1120 is greater than about 10,000 hertz. In certain embodiments, frequency 1120 is greater than about 100,000 hertz. In certain embodiments, frequency 1120 is greater than about 500,000 hertz.

In step 1230, Applicant's light bulb transforms the first AC power into second AC power having the first frequency and a second voltage. In step 1240, Applicant's light bulb rectifies the second AC power into second DC power having the second frequency.

In certain embodiments, voltage converter 110 comprises one or more capacitors for transferring charge to boost the voltage. In certain embodiments, converter 110 uses inductors as energy storage elements to boost the voltage.

Figure 2:
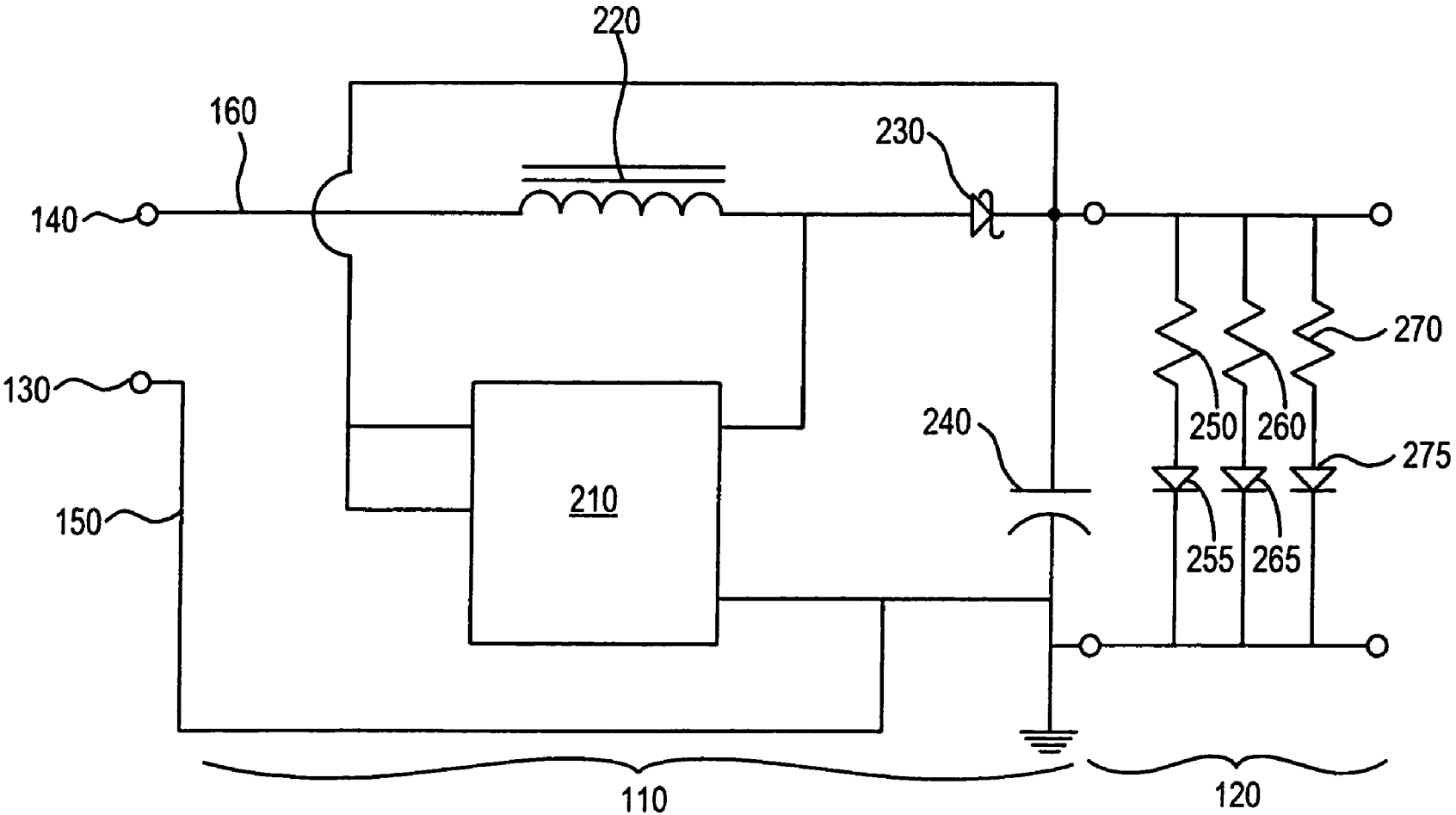
FIG. 2 is a block diagram of a second embodiment of Applicant's bulb.

In certain embodiments, in step 1250 Applicant's light bulb regulates the second DC power provided by converter 110. Referring to FIG. 2, in certain embodiments converter 110 includes device 210 comprising an NCP1402 SN50T 2, which is a DC to DC converter with a voltage regulator. In the embodiment of FIG. 2, converter 110 further includes a 47 microhenry inductor 220 and an On Semiconductor MBR0520LT1 Schottky diode 230.

In certain embodiments, in step 1260 Applicant's light bulb filters the second DC power. In certain embodiments, Applicant's apparatus 110 further includes capacitor 240 to filter out a residual AC ripple component of the second DC power provided by converter 210. In certain embodiments; capacitor 240 comprises a low ESR Tantalum capacitor. In certain embodiments, capacitor 240 can be eliminated because the flicker of the lighting device will be well above human perception due to the high switching frequency of the converter 120.

In certain embodiments, in step 1270, Applicant's light bulb converts the second DC power to third DC power having a lower current. Referring again to FIGS. 1 and 2, the one or more light emitting devices 120 of FIG. 1 comprise LEDs 255, 265, and 275, in FIG. 2. The embodiment of FIG. 2 includes resistors 250, 260, and 270, that limit current through LEDs 255, 265, and 275, respectively. In certain embodiments, LEDs 255, 265, and 275, are closely matched in voltage drop, and therefore, a single resistor is used for all three LEDs. In certain embodiments, resistors 255, 265, and/or 275, comprise a negative temperature coefficient to limit the current through the LEDs with increasing temperature. This is desirable if the LEDs are operated at a high current level close to the design point of those LEDs.

The value of the current limiting resistors is determined by several factors including the output voltage converter 110 (FIG. 1). By designing the output voltage of the regulator to substantially match the voltage drop of the LEDs, the power lost in the current limiting resistors is minimized. Additionally the current density in the inductor can be used as a limiting factor in the maximum power delivered by the converter to limit the current through the LEDs.

An alternative embodiment of the invention uses current sources in place of the current limiting resistors. The current source or sources could also be integrated on a single substrate with the DC to DC converter in the optimal design. Likewise, the current sources could be separate components.

Figure 14:
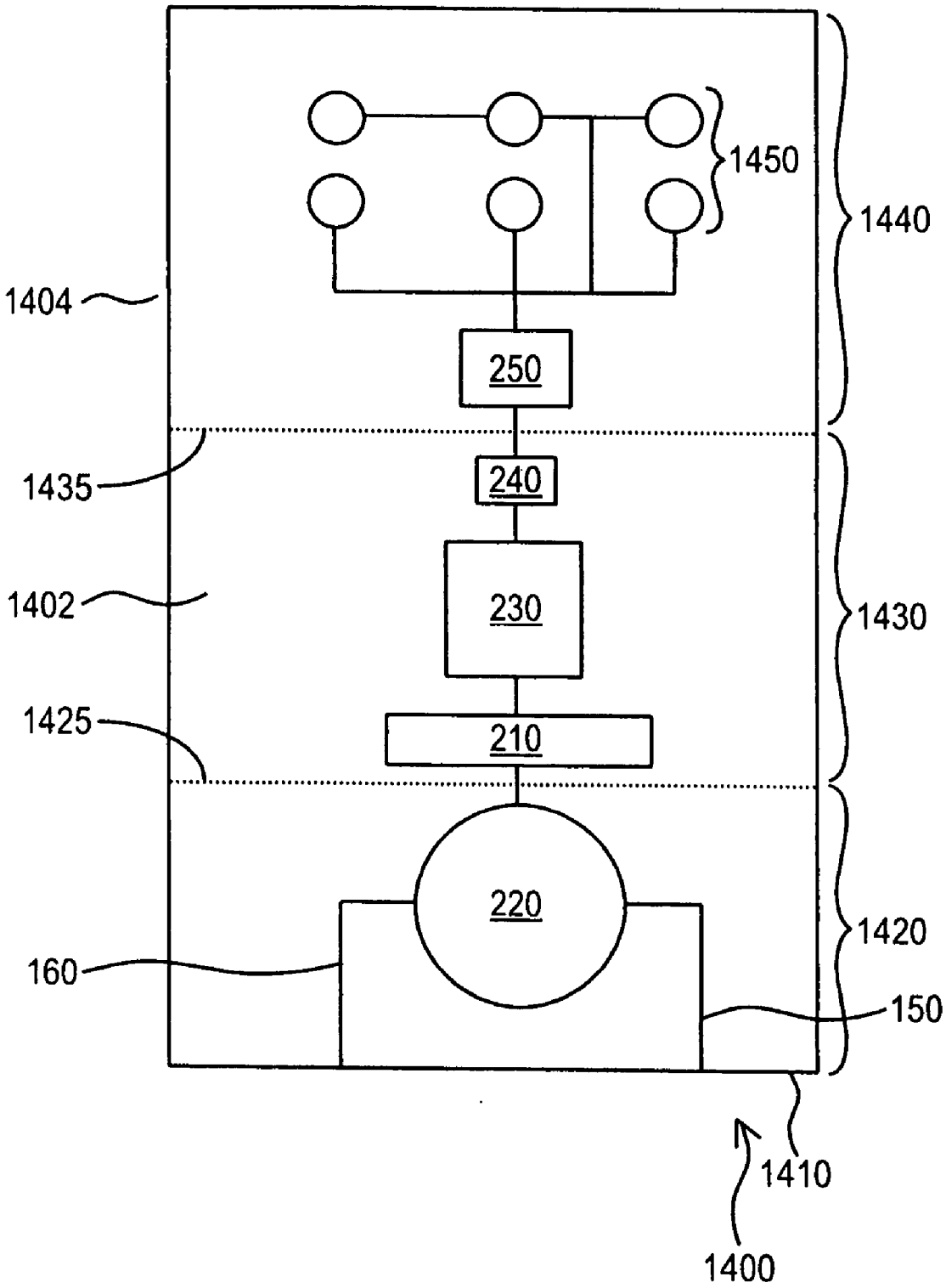
FIG. 14 is a block diagram showing the components of Applicant's bulb disposed on a flexible substrate.

FIG. 14 shows embodiment 1400 of Applicant's apparatus 100 using the components of FIGS. 1 and 2. Flexible circuit substrate 1410 comprises a non-electrically conductive polymeric film. In certain embodiments, substrate 1410 comprises a polyimide film. In certain embodiments, substrate 1410 comprises a polyamideimide film. Substrate 1410 comprises one or more circuit tracks and one or more power conductors disposed thereon. As those skilled in the art will appreciate, the circuitry and power conductors may be formed using conventional techniques. Substrate 1410 includes three portions separated by two fold lines. Portion 1420 comprises a first end segment, portion 1430 comprises a middle segment, and portion 1440 comprises a second end portion. Fold line 1425 is disposed between, end portion 1420 and middle portion 1430. Fold line 1435 is disposed between end portion 1440 and middle portion 1430.

Inductor 220 is disposed on end portion 1420. Diode 230, converter 210, and capacitor 240 are disposed on the middle portion 1430. One or more LEDs 1450 are disposed on portion 1440. Substrate 1410 can be folded along fold lines 1425 and 1435, and then disposed with the base portion of Applicant's light bulb. In the embodiment of FIG. 14, a single resistor 250 (FIG. 2) limits the current to the LEDs. Although FIG. 14 shows use of two fold lines, in other embodiments Applicant's flexible substrate 1410 includes more than two fold lines. In certain embodiments, Applicant's flexible substrate 1410 includes a single fold line.

Other packaging embodiments include using a wire lead frame. In these embodiments, the entire assembly is inserted in and soldered to, a metal base portion. That base portion is then encapsulated with a non-conductive filler. Such an encapsulant comprises, for example, an epoxy resin. In other embodiments, the components of FIG. 2 are disposed on a custom lead frame, and that entire assembly is then encapsulated in a polymeric material. That encapsulated device is then inserted into the base component of Applicant's apparatus.

In certain embodiments, the base assembly comprises a single, molded, three-dimensional circuit substrate. In these embodiments, components 110, 150, 160, 170, 180, and optionally 1310, are disposed internally within that molded portion, and contacts 130 and 140 are disposed on the surface of that molded portion.

Figure 3:
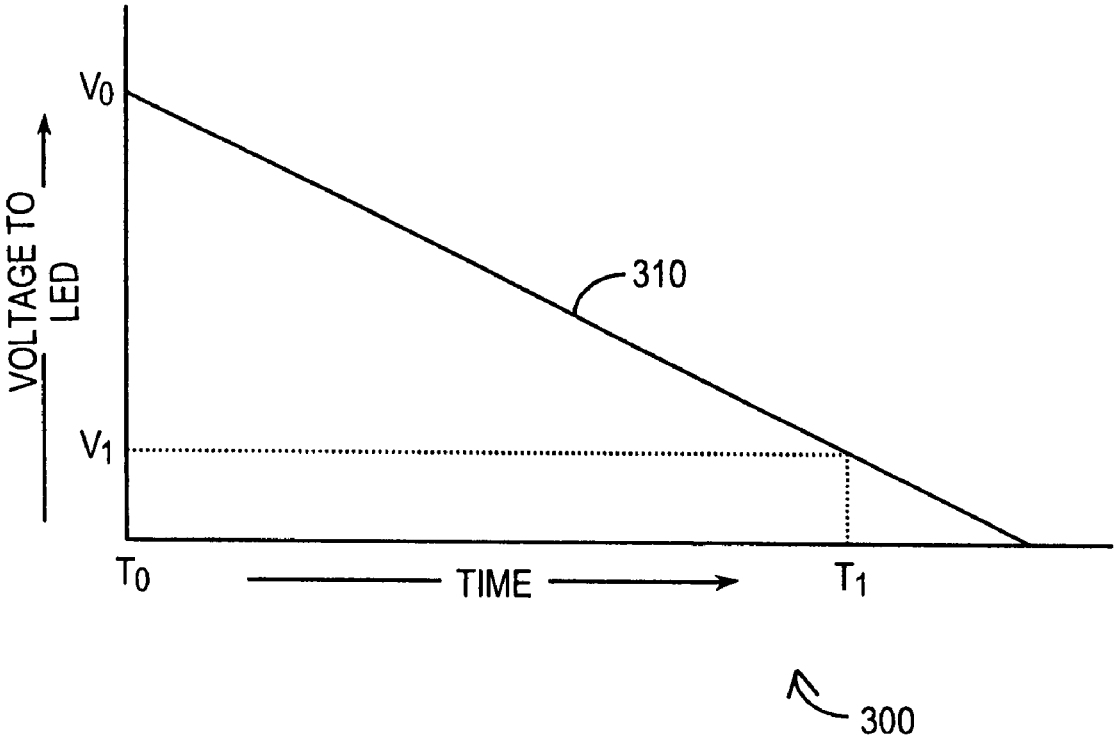
FIG. 3 PRIOR ART
FIG. 3 is a graph showing the voltage supplied over time by one or more batteries to the lighting element of a prior art light bulb.

The performance of Applicant's flashlight comprising light bulb 110 differs dramatically from prior art hand-carried lighting devices. As those skilled in the art will appreciate, the voltage level provided by a series of batteries decreases over time. Referring now to FIG. 3, curve 310 represents the voltage level of DC power provided by a series of batteries. Early on at time $T_0$, the DC power has a voltage. $V_0$, where at time $T_0$ the one or more batteries have been used for about one percent (1%) of their useful lifetimes. At time $T_1$, where time $T_1$ comprises about 90 percent of the batteries' maximum useful lifetime, that voltage has decreased to voltage $V_1$.

As a general matter, the voltage provided by one or more battery cells is inversely proportional to the duration of use. FIG. 3 shows a linear relationship between the voltage provided as a function of time. In certain embodiments, that relationship may be more complex, i.e. a quadratic function, a cubic function, and the like.

Figure 4:
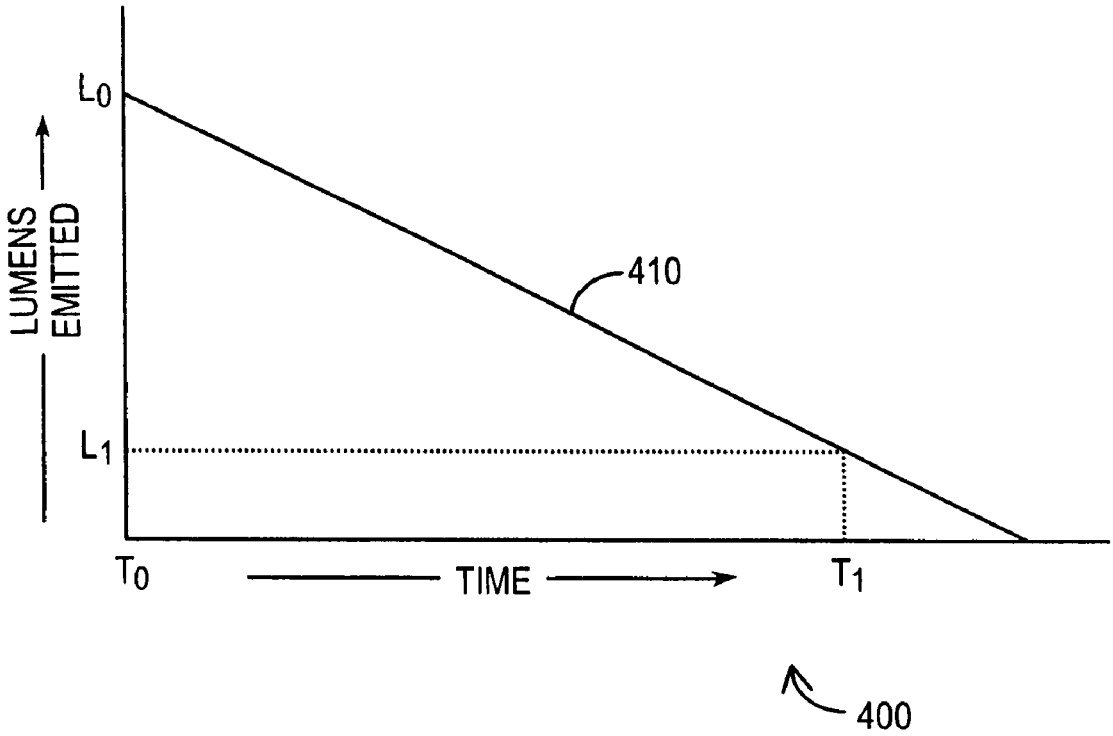
FIG. 4 PRIOR ART
FIG. 4 is a graph showing the intensity of light emitted over time by prior art light bulbs using the voltage of FIG. 3.

Referring now to FIG. 4, curve 410 represents the intensity in Lumens of the visible light emitted from one or more light emitting elements/devices receiving the DC power of curve 310 (FIG. 3). Initially, i.e. at time $T_0$, the one or more light emitting elements/devices emit visible light having an intensity $L_0$. However, at time $T_1$ that intensity has diminished to level $L_1$, where $L_1$ is less than 50 percent of $L_0$. As a general matter, the intensity of radiation emitted provided by an electromagnetic energy emitter powered by one or more battery cells is inversely proportional to the duration of use. FIG. 4 shows a linear relationship between the intensity of radiation emitted as a function of time. In certain embodiments, that relationship may be more complex, i.e. a quadratic function, a cubic function, and the like.

Figure 5:
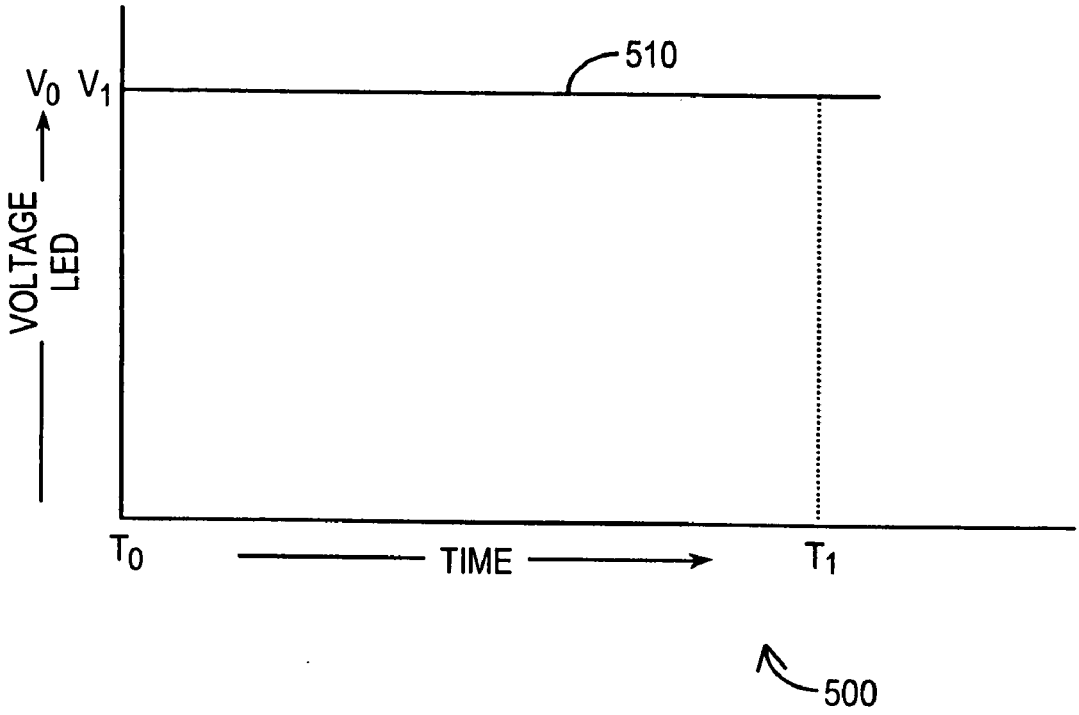
FIG. 5 is a graph showing the voltage supplied over time by one or more batteries to the lighting elements of Applicant's bulb.
Figure 6:
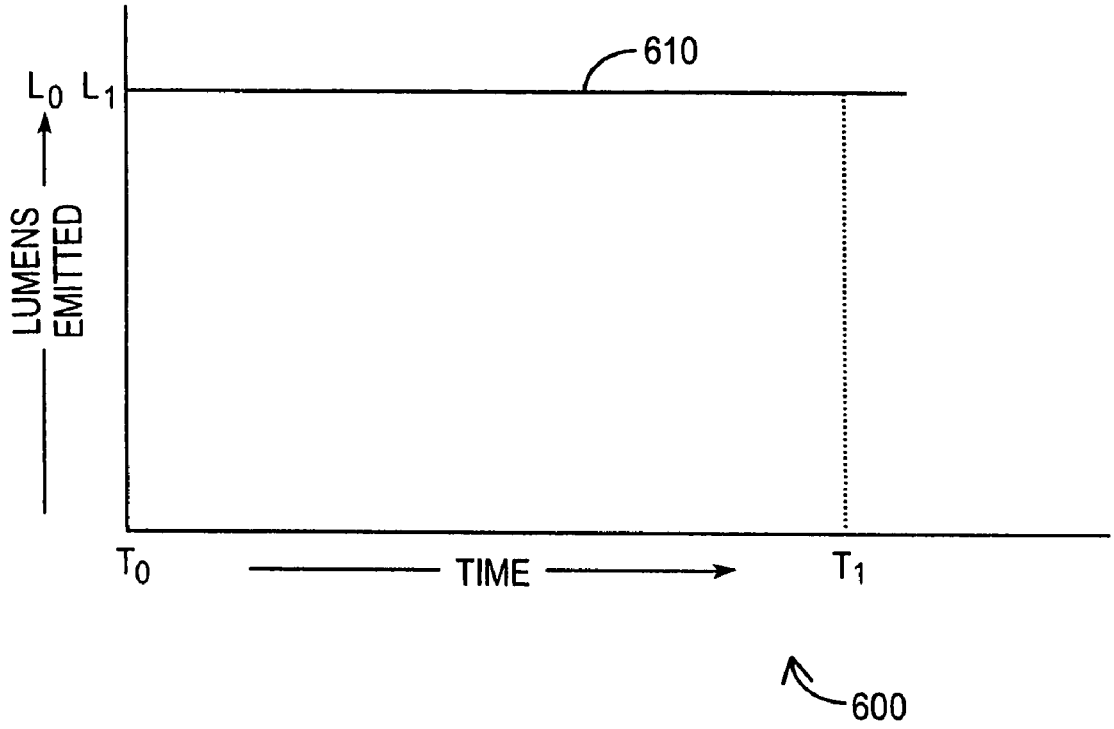
FIG. 6 is a graph showing the intensity of electromagnetic radiation emitted over time by Applicant's bulb.

Referring now to FIG. 5, curve 510 represents the voltage level of the DC power provided to one or more light emitting elements/devices 120 (FIG. 1) by converter assembly 110 (FIG. 1). Initially, i.e. at time $T_0$, the DC power provided has a voltage $V_0$. At time $T_1$, where time $T_1$ comprises about 90 percent of the batteries' maximum useful lifetime, that voltage is still substantially equal to voltage $V_1$. By substantially equal, Applicant means within plus or minus about ten percent (10%). Referring now to FIG. 6, curve 610 represents the intensity in Lumens of the visible light emitted from one or more one or more light emitting elements/devices receiving the DC power of curve 510 (FIG. 5). Initially, i.e. at time $T_0$, the one or more light emitting elements/devices emit visible light having an intensity $L_0$. At time $T_1$ that the one or more light emitting elements/devices emits visible light having intensity $L_1$, where $L_1$ is substantially equal to $L_0$. By "one or more light emitting elements/devices," Applicant means one or more incandescent elements, one or more LEDS, or combinations thereof.

Referring again to FIG. 1, power input terminals 130 and 140 are disposed on the surface of housing 190. Although FIG. 1 shows power input terminals 130 and 140 disposed on the same side of housing 190 and adjacent to one another, the configuration of FIG. 1 is not limiting. In certain embodiments, power input terminals 130 and 140 are located on different sides/surfaces of housing 190. In certain embodiments, power input terminals 130 and 140 comprise portions of a single power input plug or module. In certain embodiments, housing 110 further comprises a base portion and a cover portion.

Power input terminal 130 is attached to conductor 150. Conductor 150 is disposed within housing 190 and interconnects with power converter assembly 110. Power input terminal 140 is attached to conductor 160. Conductor 160 is disposed within housing 190 and interconnects with power converter assembly 110. As those skilled in the art will appreciate, the base portion may be configured as necessary to engage with any one of the plurality of well-known industry standard socket light bulb socket types.

In certain embodiments, the components disposed within and on housing 100 occupy the same physical form and volume as do standard incandescent light bulbs, and engage in standard sockets to fit into standard lighting fixtures such as flashlights and lanterns. The lamp base can be either a stamped metal that is used in "flashlight" bulbs today, such as an Edison screw style or a bayonet base, for example. In certain embodiments, power input terminals 130 and 140 are disposed on the outer surface of the base portion, and conductors 150 and 160 along with converter assembly 110 are internally disposed within the base portion.

In certain embodiments Applicant's light bulb apparatus includes a translucent or transparent cover for the lighting elements. In these embodiments, the cover portion surrounds and protects the one or more light emitting elements/devices. In certain embodiments, converter 110 may be disposed within the cover portion of Applicant's light bulb.

In certain embodiments, the cover portion diffuses the light emitted from the one or more light emitting elements/devices 120. Such a cover portion diffuses and combines the light emitted by the one or more light emitting elements/devices to provide a pleasing appearance. In the embodiments where the entire unit is constructed as a plastic injection molding the plastic cover is just a design element of the whole. The plastic cover can also be made to have a decorative appearance when the bulb will be decorative in function.

Figure 7:
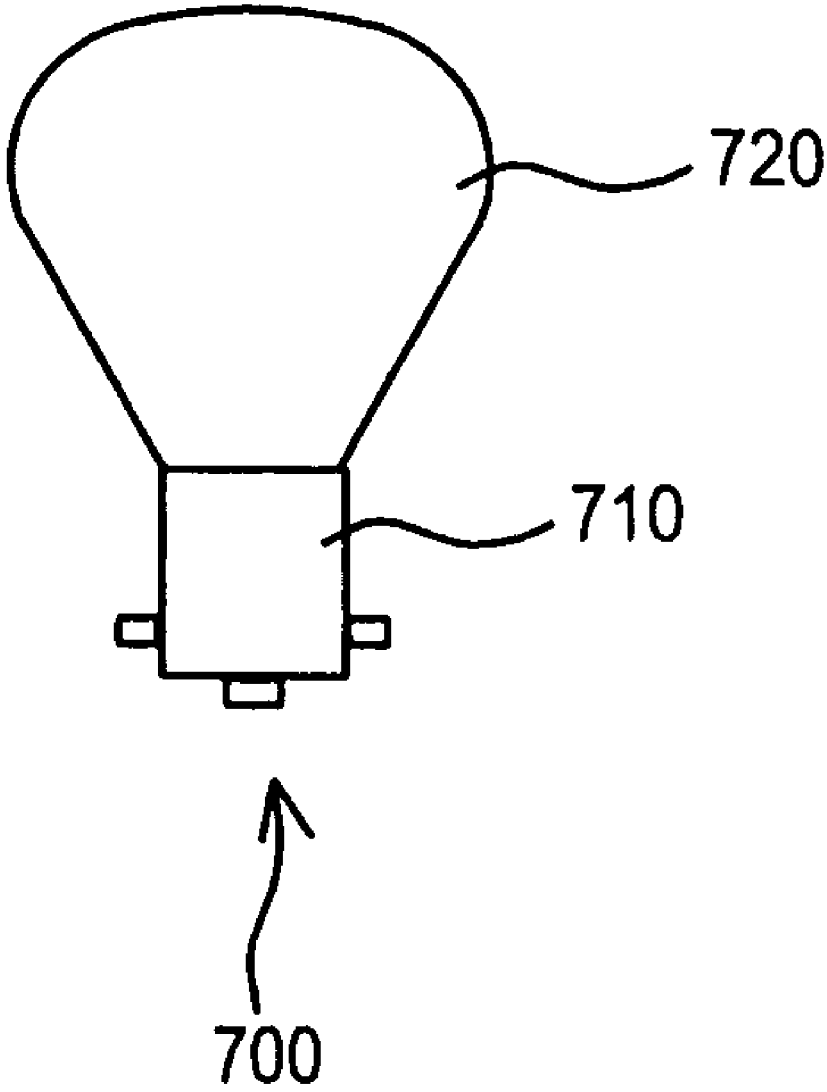
FIG. 7 is a first embodiment of the form factor of Applicant's bulb.

For example, FIG. 7 shows embodiment 700 of Applicant's apparatus which includes bayonet mount base portion 710 and cover portion 720. As those skilled in the art will appreciate, embodiment 700 is first pushed into a compatible socket and then twisted until locked in that socket.

Figure 8:
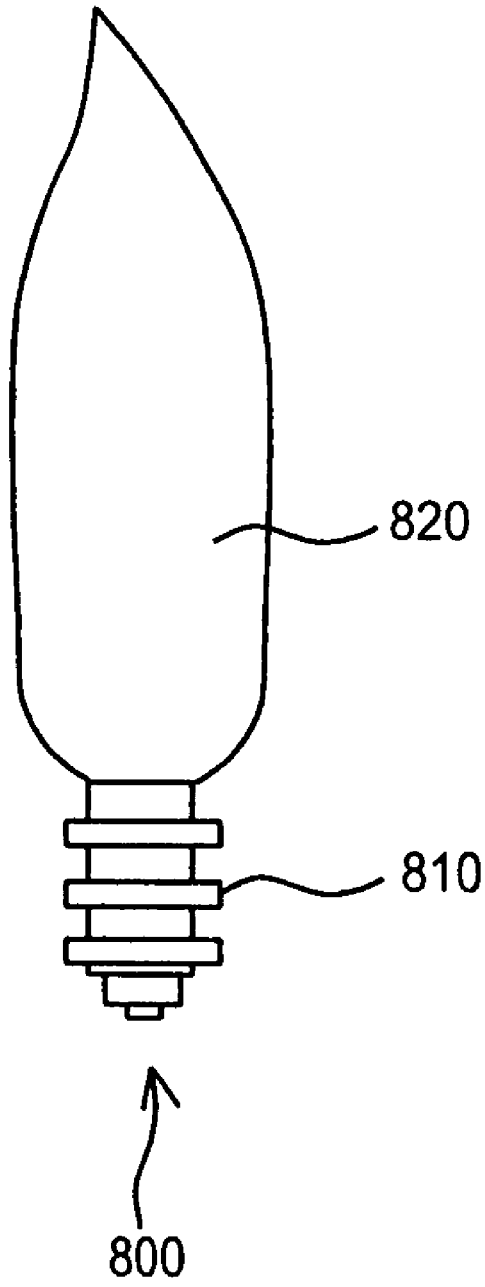
FIG. 8 is a second embodiment of the form factor of Applicant's bulb.
Figure 13:
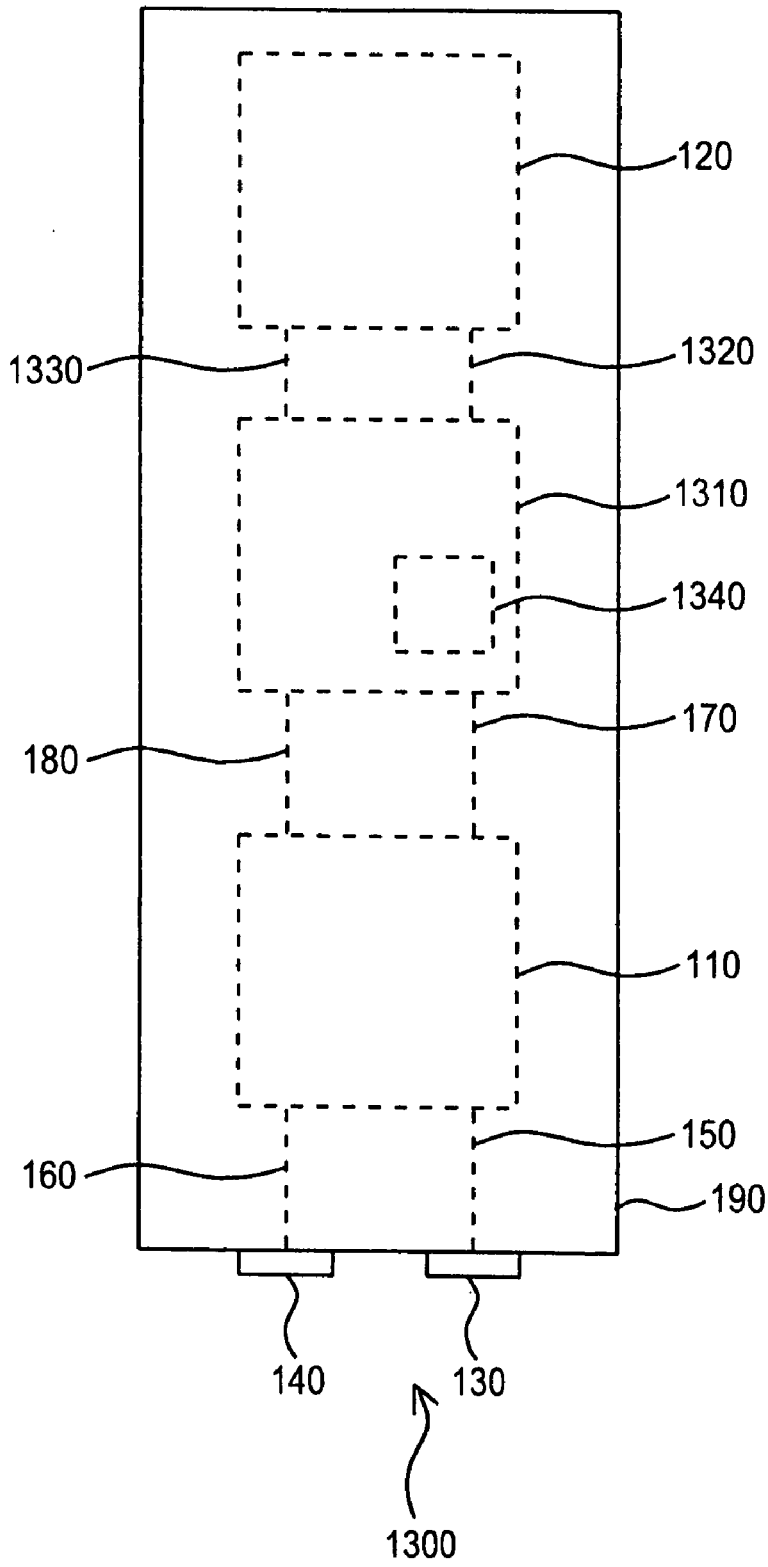
FIG. 13 is a block diagram showing an embodiment of Applicant's bulb that includes a microprocessor.

FIG. 8 shows embodiment 800 of Applicant's apparatus which includes a regular or a mini-candelabra screw mount comprising base 810. Cover portion 820 is formed in the shape of a candle flame. Referring now to FIG. 13, in certain embodiment 1300 Applicant's apparatus further includes microprocessor 1310 disposed between voltage converter 110 and plurality of LEDs 120. Microprocessor 1310 receives the filtered, regulated DC power from converter 110 and supplies that DC power to individual LEDs based upon a program 1340 disposed within microprocessor 1310. In certain embodiments, program 1340 provides DC power to individual LEDs comprising plurality of LEDs 120 such that the visual output of apparatus 1300 appears to comprise a candle flame. U.S. Pat. No. 5,924,784 teaches a method and apparatus to emit visible light simulating the appearance of a candle flame, and is hereby incorporated herein by reference. U.S. pending application having Ser. No. 09/783,374 teaches circuitry By "microprocessor," Applicant means a device that provides DC power to one or more, but not continuously to each, individual LED comprising plurality of LEDs 120. In certain embodiments, microprocessor 1310 comprises a computer processor in combination with computer code, i.e. a combination of computer hardware and software to provide DC power to one or more, but not continuously to each, individual LED comprising plurality of LEDs 120. In certain embodiments, microprocessor 1310 comprises an application specific integrated circuit comprising "firmware" to provides DC power to one or more, but not continuously to each, individual LED comprising plurality of LEDs 120.

Figure 9:
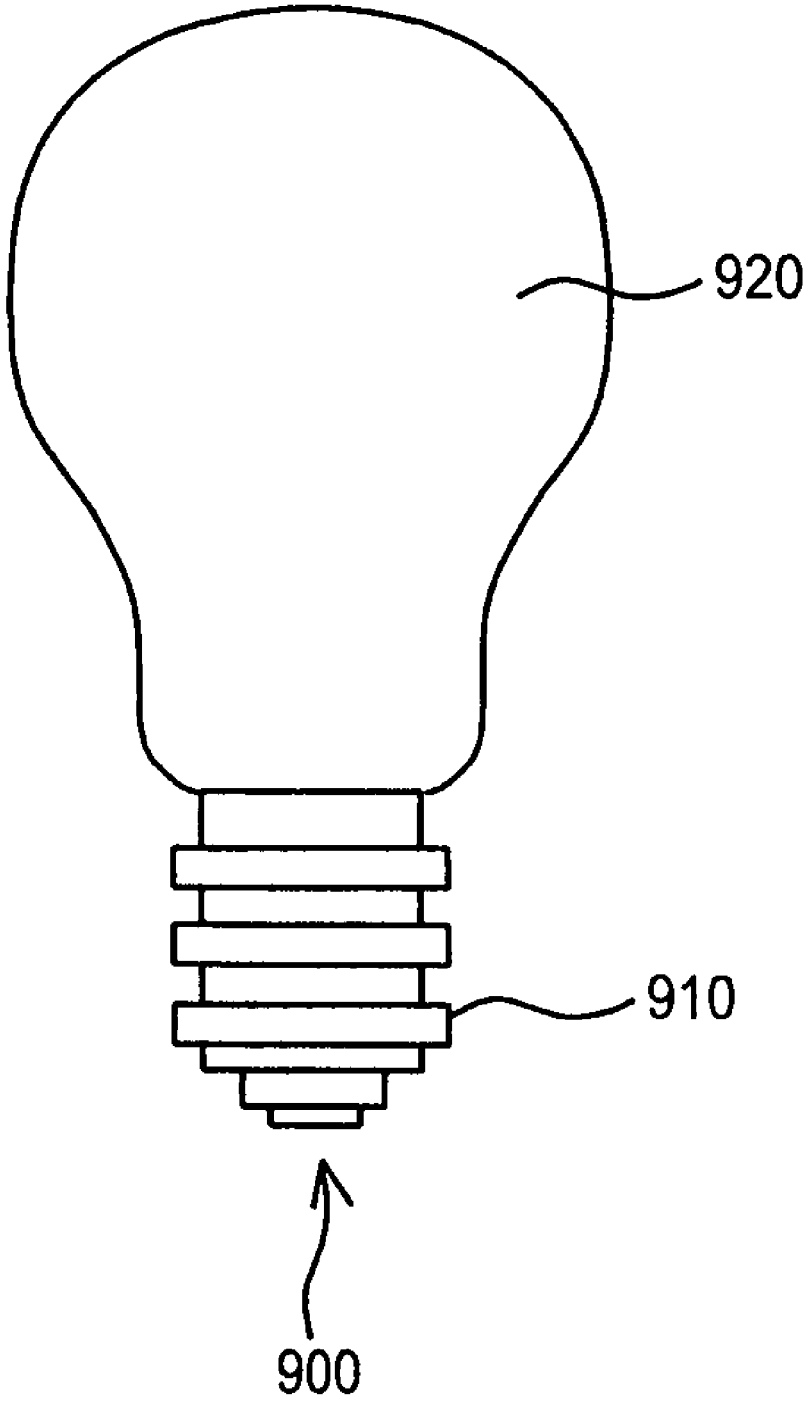
FIG. 9 is a third embodiment of the form factor of Applicant's bulb.

FIG. 9 shows embodiment 900 of Applicant's apparatus which includes screw-in mount base portion 910 and cover portion 920. As those skilled in the art will appreciate, embodiment 900 is inserted into a compatible socket and rotated until locked in that socket. As those skilled in the art will appreciate, in certain embodiments base portion 910 has a size commonly referred to as a "medium" size. That medium size is larger in diameter than either the candelabra mount or mini-candelabra mount of FIG. 8. In certain embodiments base portion 910 has a size commonly referred-to as a "mogul" size, where that mogul mount has a diameter greater than the medium mount.

Figure 10:
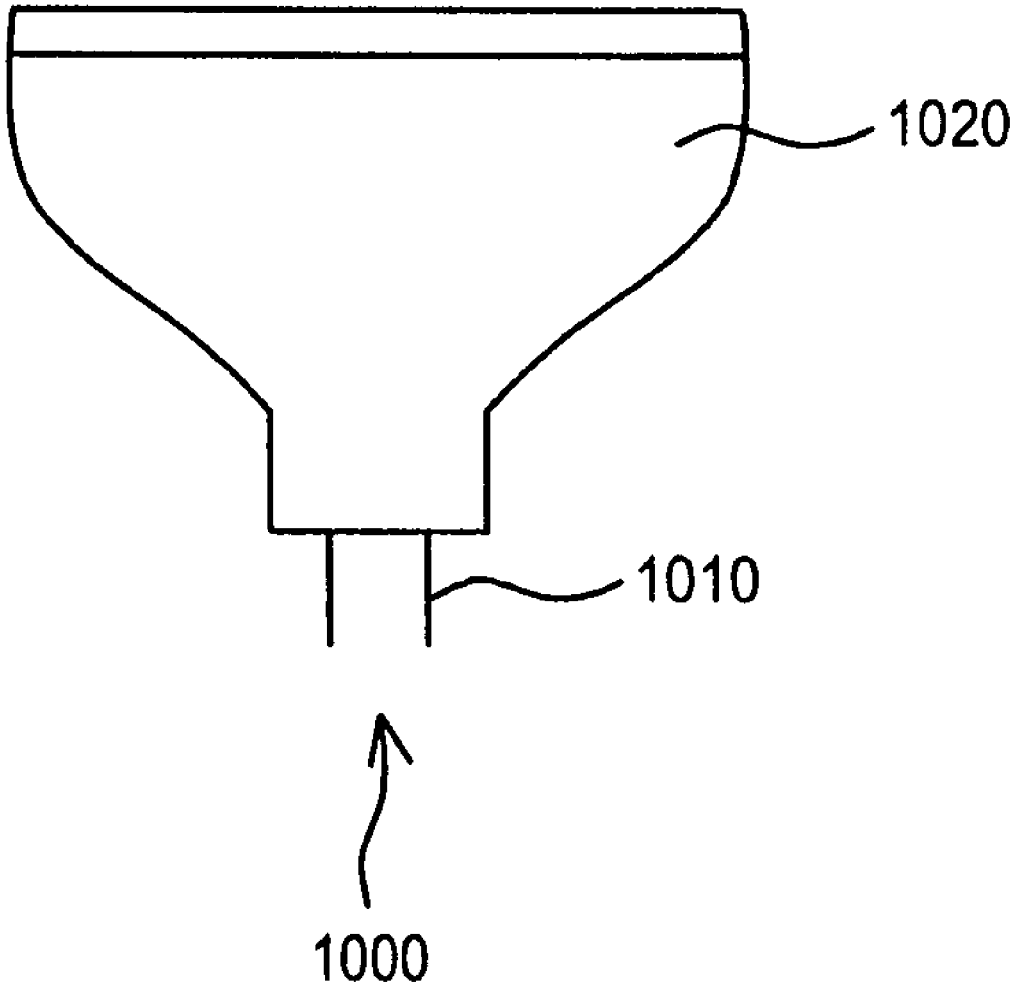
FIG. 10 is a fourth embodiment of the form factor of Applicant's bulb.

FIG. 10 shows embodiment 1000 of Applicant's apparatus which includes a two pin mount base portion 1010 and cover portion 1020. As those skilled in the art will appreciate, base configuration 1010 is often used in, for example, projector bulbs, low voltage track lighting, and cable lighting systems.

While the preferred embodiments of the present invention have been illustrated in detail, it should be apparent that modifications and adaptations to those embodiments may occur to one skilled in the art without departing from the scope of the present invention as set forth in the following claims.

We claim:

1. A method to emit electromagnetic radiation from a hand-carried device, comprising the steps of:

providing a portable apparatus comprising a bulb assembly and one or more battery cells;

supplying first DC power having a first voltage from said one or more battery cells to said bulb assembly;

converting within said bulb assembly said first DC power to first AC power having said first voltage and a first frequency;

converting within said bulb assembly said first AC power to second AC power having a second voltage and said first frequency; and converting within said bulb assembly said second AC power to said second DC power having said second voltage;

supplying within said bulb assembly said second DC power to one or more electromagnetic radiation emitting elements/devices disposed therein; and emitting electromagnetic radiation from said hand-carried device.

2. A method to emit electromagnetic radiation from a hand-carried device, comprising the steps of:

providing a portable apparatus comprising a bulb assembly and one or more battery cells;

supplying first DC power having a first voltage from said one or more battery cells to said bulb assembly;

converting within said bulb assembly said first DC power to second DC power having a second voltage;

supplying within said bulb assembly said second DC power to one or more electromagnetic radiation emitting elements/devices disposed therein; and emitting electromagnetic radiation from said hand-carried device wherein said one or more electromagnetic energy emitting devices comprise one or more light emitting diodes having a voltage drop, and wherein said second voltage is greater than said voltage drop.

3. The method of claim 2, further comprising the step of converting said second DC power to third DC power having a third voltage.

4. The method of claim 3, wherein said third voltage is substantially equal to said voltage drop.

5. The method of claim 2, further comprising the steps of:

supplying second DC power having a first current a first light emitting diode;

supplying second DC power having a second current to a second light emitting diode; and supplying second DC power having a third current to a third light emitting diode.

6. The method of claim 2, wherein said one or more light emitting diodes comprises a first plurality of light emitting diodes, a second plurality of light emitting diodes, and a third plurality of light emitting diodes, further comprising the steps of:

supplying second DC power during a first time period to said first plurality of light emitting diodes but not supplying second DC power during said first time period to said second plurality of light emitting diodes or to said third plurality of light emitting diodes;

supplying second DC power during a second time period to said second plurality of light emitting diodes but not supplying second DC power during said second time period to said first plurality of light emitting diodes or to said third plurality of light emitting diodes; and supplying second DC power during a third time period to said third plurality of light emitting diodes but not supplying second DC power during said third time period to said second plurality of light emitting diodes or to said first plurality of light emitting diodes.

* * * * *